United States Patent [19]

Wei

[11] Patent Number: 4,820,908

[45] Date of Patent: Apr. 11, 1989

[54] COMBINED CALCULATOR AND PUZZLE GAME DEVICE

[75] Inventor: Chih-Ming Wei, Taipei, Taiwan

[73] Assignee: Limax Electronics Co., Ltd., Taipei, Taiwan

[21] Appl. No.: 209,523

[22] Filed: Jun. 21, 1988

[51] Int. Cl.[4] ..... G06C 7/02

[52] U.S. Cl. ..... 235/145 R; 235/1 B; 235/123; 200/5 A; 364/410

[58] Field of Search ..... 235/1 B, 1 D, 123, 145 R, 235/145 A; 200/5 A; 206/365; 364/410–412, 708

[56] References Cited

U.S. PATENT DOCUMENTS 3,823,309 7/1974 Caruso ..... 235/145 R
4,398,086 8/1983 Smith ..... 364/410 X
4,468,542 8/1984 Pounds ..... 200/5 A

*Primary Examiner*—B. R. Fuller
*Attorney, Agent, or Firm*—Brumbaugh, Graves, Donohue & Raymond

[57] ABSTRACT

A combined calculator and puzzle game device including a calculator cover-board which is provided with guide pieces confined to intersecting guide grooves. Game pieces which have projecting necks are mounted on the guide pieces by inserting the projecting necks into the guide grooves allowing them to be slid along the guide grooves, but not be removed. The game pieces can be rearranged on the cover board to bear a particular pattern or a combination of characters. When the game pieces are depressed, they push rubber keys placed therebelow so as to operate the calculator.

1 Claim, 2 Drawing Sheets

COMBINED CALCULATOR AND PUZZLE GAME DEVICE

BACKGROUND OF THE INVENTION

This invention relates to a game device and particularly to a combined calculator and puzzle game device which has a construction substantially similar to a calculator with moving game pieces whose surfaces bearing characters or parts of a pattern which can be selectively moved on the cover board of the calculator so as to form a combination of characters or a particular pattern.

The object of the invention is to provide a device which can be used as a calculator as well as a puzzle game device.

SUMMARY OF THE INVENTION

The present invention provides a combined calculator and puzzle game device which comprises a calculator having a cover board disposed over a rubber membrane which has projecting keys. The cover board has a panel which has a plurality of interspaced rows of holes for allowing the projecting keys to extend through the panel, and plate-like interspaced guide pieces lying in a plane above the panel, each of the guide pieces having a bottom neck support projecting from the panel, the guide pieces being arranged in rows which are spaced apart to form grooves intersecting at the locations in agreement with the alignment of the holes, and the grooves being restricted between the guide pieces and broadened between the bottom neck supports, each guide piece being marked with a numeral. Game pieces are placed on the guide pieces, each of the game pieces having a bottom projecting neck which has an end flange, the projecting necks of the game pieces movably extending into the grooves, the end flanges of the game pieces preventing the game pieces from being released from the cover board, each game piece partially covering the four adjacent guide pieces and having an opening for exposing the numeral of one of the guide pieces. The projecting necks of the game pieces come into contact with the projecting keys when the game pieces are depressed. The game pieces are further provided with marks thereon which can be combined to form a particular pattern or a combination of characters upon rearranging the game pieces. The cover board further has a vacant recess capable of receiving one of the game pieces for allowing the game pieces to move for rearrangement.

The present exemplary preferred embodiment will be described in detail with reference to the accompanying drawings, in which:

DETAILED DESCRIPTION OF THE PREFERRED EMBODIMENT

Figure 1:
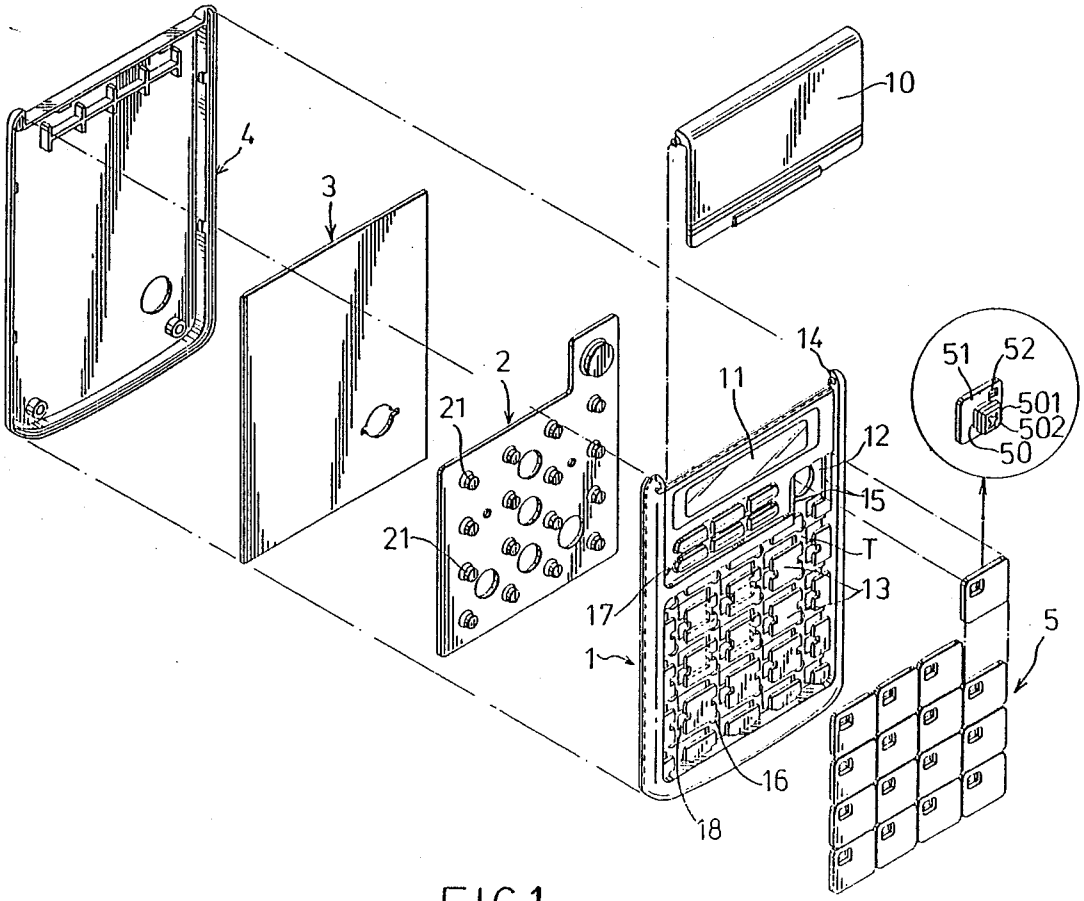
FIG. 1 is an exploded view of a combined calculator and puzzle game device according to the present invention.

Referring to the drawings, a preferred embodiment of the present invention is shown, having a base tray 4, a cover plate 10 hinged to one side of an upper board 1, a calculator PC board 3, a rubber key membrane 2, and a plurality of moving calculator keys pieces 5.

The calculator PC board 3 and the rubber membrane 2 are mounted in the tray 4. Since the construction of the boards 3 and 2 are known, the detail thereof is not described hereinafter.

The cover board 1 is connected to the base tray 4 and has a panel formed with a surrounding raised edge. On the panel are formed a display 11, a recess 12, guide pieces 13, holes 16 and keys 17. The holes 16 are registered with projecting keys 21 of the rubber membrane 2 so as to permit the keys 21 to extend therethrough. In the recess 12 are provided two guide members 15 and an on-off key 53. Each guide piece 13 is integrally formed with a bottom support neck 131 projecting from the panel of the cover board 1. The guide pieces 13 are lain in a plane above the panel of the cover board 1 and are spaced apart to leave intersecting grooves 18 along the rows of the holes 16. The grooves 18 are narrowed between the guide pieces 13 and broadened between projecting necks 131. Each guide piece 13 is provided with a numeral adjacent to one of the corners thereof.

Game pieces 5 are mounted on the cover board 1. Each game piece 5 has a plate 51 with a bottom projecting neck 50 which has a flange 501 and a protrusion 502 and is inserted in a groove 18 at one of the intersecting points of the grooves 18. The flange 501 of each projecting neck 50 prevents each game piece 5 from being released from the grooves 18. Each game piece 51 covers parts of four adjacent guide pieces 13 and has an opening 52 to expose the numeral of one of the four adjacent guide pieces 13. Also the surface of each game piece 51 bears a portion of a design pattern such as that given as an example in FIGS. 3 and 4, which is inclusive a circle encompassing a combination of characters.

Figure 4:
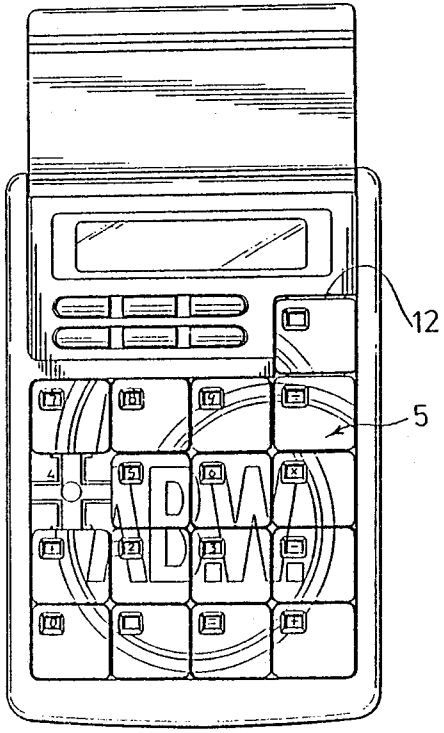
FIGS. 3 and 4 are plan views of the calculator of FIG. 1.
Figure 3:
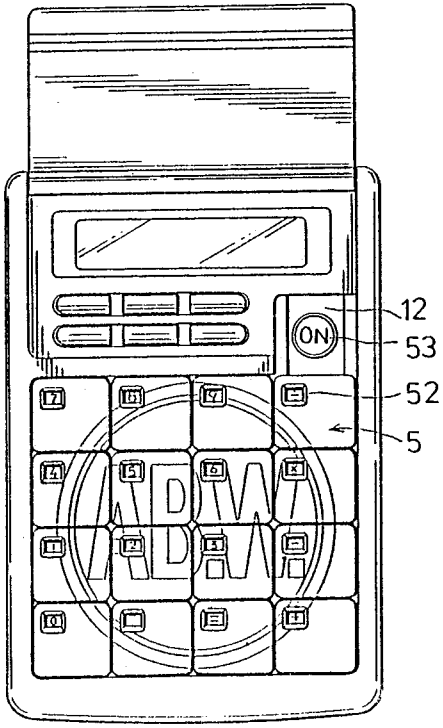
Figure 2:
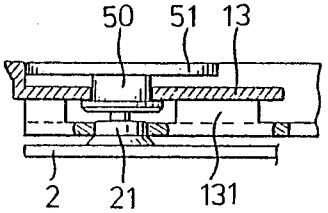
FIG. 2 is an enlarged sectional view of a portion of the device of FIG. 1.

As shown in FIGS. 3 and 4, the cover board 1 is left with a vacant space so that at least one of the game pieces 5 is allowed to move on the cover board 1 to reach a target position. When the present invention is to be used as a calculator, all the spaces of the cover board 1 should be filled except the recess 12. The numerals exposed through the openings 52 of the game pieces 5 can be used for calculation purposes. When the game pieces 5 are depressed the projecting necks 50 of the game pieces 5 push the projecting keys 21 of the rubber membrane 2, thereby operating the calculator.

When the present invention is used as a game, one may move a game piece 5 to the recess 12 and then rearrange the game pieces 5 until a logical pattern is formed on the game pieces 5.

With the invention thus explained, it is apparent that numerous modifications and variations can be made without departing from the scope of the invention. It is therefore intended that the invention be limited only as indicated in the appended claims.

What I claim is:

1. A combined calculator and puzzle game device comprising:

a base tray;

a calculator printed circuit board mounted in said base tray;

a rubber membrane placed on said calculator printed circuit board and having projecting keys;

a cover board placed over said rubber membrane and connected to said base tray, said cover board having a panel which has a plurality of rows of holes allowing said projecting keys to extend through said panel, and plate-like guide pieces interspaced and lying in a plane above said panel, each of said guide pieces having a bottom neck support projecting from said panel, said guide pieces being arranged in rows which are interspaced so as to form grooves which intersect at locations in agreement with the alignment of said holes, said grooves being restricted between said guide pieces and broadened between said bottom neck supports, each of said guide pieces being marked with a numeral;

game pieces movably disposed on said guide pieces, each of said game pieces having a bottom projecting neck which has an end flange, said projecting necks of said game pieces movably extending into said grooves, said end flanges of said game pieces preventing said game pieces from being released from said cover board, each of said game pieces partially covering parts of four adjacent guide pieces and having an opening for exposing said numeral of one of said four adjacent guide pieces, said projecting necks of said game pieces pushing said projecting keys when said game pieces are depressed, said game pieces further having marks thereon which can be combined to form a particular pattern or a combination of characters upon rearranging said game pieces;

said cover board further having a vacant recess capable of receiving one of said game pieces for allowing said game pieces to move for rearrangement.

* * * * *